US011932438B1

(12) United States Patent
Myers et al.

(10) Patent No.: US 11,932,438 B1
(45) Date of Patent: Mar. 19, 2024

(54) BAG RACK

(71) Applicant: Toshiba Global Commerce Solutions, Inc., Durham, NC (US)

(72) Inventors: Robert Andrew Myers, Cary, NC (US); Kevin Gierl, Cary, NC (US)

(73) Assignee: TOSHIBA GLOBAL COMMERCE SOLUTIONS, INC., Durham, NC (US)

( * ) Notice: Subject to any disclaimer, the term of this patent is extended or adjusted under 35 U.S.C. 154(b) by 0 days.

(21) Appl. No.: 18/123,017

(22) Filed: Mar. 17, 2023

(51) Int. Cl.
*B65B 67/12* (2006.01)

(52) U.S. Cl.
CPC ..... *B65B 67/1227* (2013.01); *B65B 67/1266* (2013.01)

(58) Field of Classification Search
CPC ..... B65B 67/1227; B65B 67/1266
USPC ..... 248/97
See application file for complete search history.

(56) References Cited

U.S. PATENT DOCUMENTS 4,538,783 A * 9/1985 Stobbe ..... B65B 67/1244 211/85.15
5,012,994 A * 5/1991 Keefe ..... B65B 67/1227 248/302
5,190,253 A * 3/1993 Sable ..... B65B 67/1205 D34/5
5,513,823 A * 5/1996 Bresnahan ..... B65B 67/1205 403/103
6,089,514 A * 7/2000 Huang ..... B65B 43/14 248/95
7,677,507 B1 * 3/2010 Rothbauer ..... B65B 67/12 248/95
9,622,599 B2 * 4/2017 Davis, Jr. ..... A47F 9/042
2010/0096514 A1 * 4/2010 Adair ..... B65B 67/1266 248/97
2014/0138499 A1 * 5/2014 Laitila ..... B65B 67/1227 248/97
2014/0263121 A1 * 9/2014 Metcalfe ..... B65B 67/1266 211/85.15
2015/0048039 A1 * 2/2015 Laitila ..... B65B 67/1233 211/85.15
2021/0298495 A1 * 9/2021 Barr ..... B65B 67/1227
2022/0192397 A1 * 6/2022 Dungan ..... A47F 13/085

* cited by examiner

*Primary Examiner* — Kimberly T Wood
(74) *Attorney, Agent, or Firm* — COATS & BENNETT, PLLC

(57) ABSTRACT

A rotatable bag rack to support a plurality of bag types. The bag rack includes a stand and a rack. The rack is pivotally mounted to the stand so as to be rotatable about a pivot axis relative to the stand between a first position to hold a first bag type and a second position to hold a second bag type. The rack includes a pair of spaced apart arms to hold the first bag type that, in the first position, extends forward relative to the pivot axis. The rack, in the second position, extends downward relative to the pivot axis. The rack also includes a hanger fixed relative to the arms to hold a second bag type that, in the first position, extends backward relative to the pivot axis. The rack, in the second position, extends upward relative to the pivot axis.

16 Claims, 10 Drawing Sheets

BAG RACK

BACKGROUND

Bag racks are commonly used by in-store retailers to store and support bags. The primary function of bag racks is to hold a particular type of bag during check-out, allowing the user to use both hands to load items into the bag. The most commonly used type of bag is the plastic t-shirt bag. However, state legislatures and environmentalists now discourage the use of the typical t-shirt bag and encourage reusable bags.

BRIEF DESCRIPTION OF THE DRAWINGS

Aspects of the present disclosure are illustrated by example and are not limited by the accompanying figures with like references indicating like elements.

DETAILED DESCRIPTION

The present disclosure is directed to a convertible bag rack for supporting various bag styles when stowed or during bagging. Embodiments disclosed herein are directed to a bag rack to support a first bag type in a first position and a second bag type in a second position. Certain embodiments provide that the first bag type is a plastic, t-shirt-style bag and the second bag type is a reusable bag. However, it should be understood that the first and second bag types are not limited to the plastic, t-shirt, and reusable bag. The first bag type and second type may include any type of disposable or reusable bag.

Generally, bag racks provided for checkout in retail stores are designed and manufactured for a particular bag. Many retailers offer both standard plastic "T-shirt" style and reusable bags, which require two different bag racks. In other cases, retailers are converting from using plastic "T-shirt" style bags to reusable bags, replacing the T-shirt bag racks with new racks for reusable bags. It may also be difficult and expensive to provide types of bags or predict the mix of bag racks required when providing both bag types.

The bag rack disclosed herein is movable between one of two support positions depending on the type of bag being supported. Users may rotate the bag rack to a position appropriate for a particular bag design and usage. Retailers can easily adapt to requirements on a day-to-day or even shopper-to-shopper basis. Retailers can also avoid the expense of purchasing and installing racks and improve customer satisfaction by providing a solution that meets the customer's needs.

Figure 1:
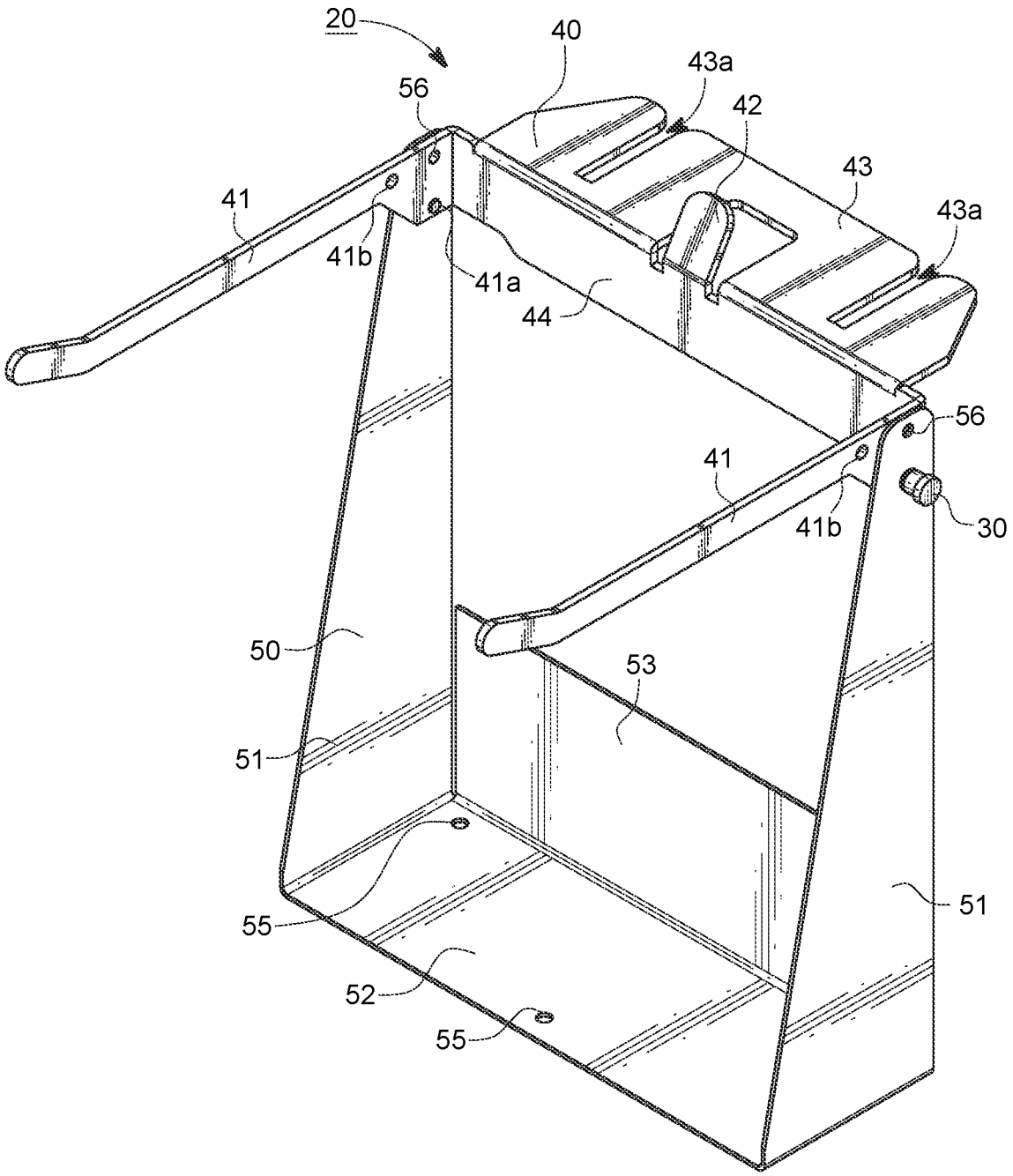
FIG. 1 is a perspective view of an exemplary bag rack in a first position.
Figure 2:
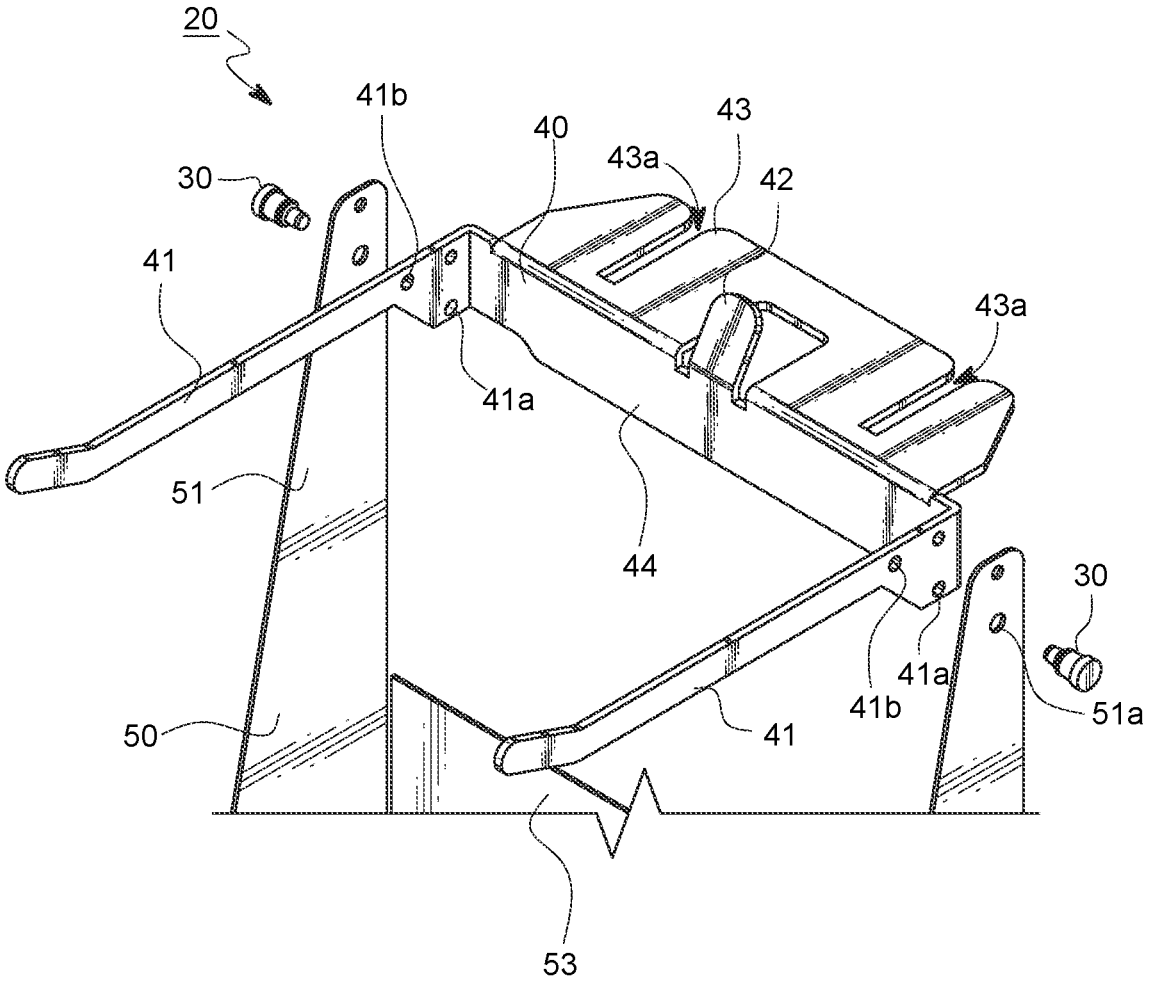
FIG. 2 is an exploded perspective view of the exemplary bag rack in the first position.
Figure 3:
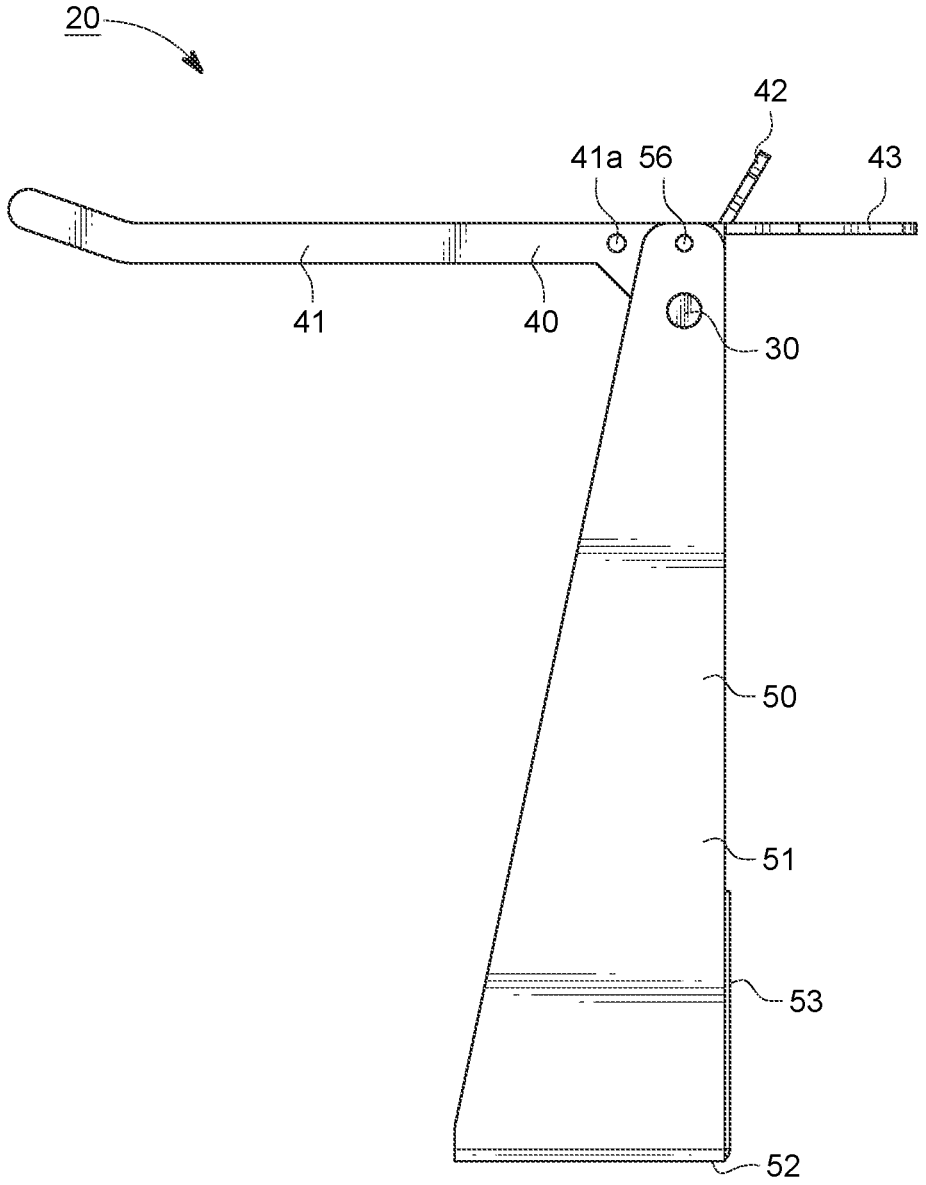
FIG. 3 is a side view of the exemplary bag rack in the first position.
Figure 4:
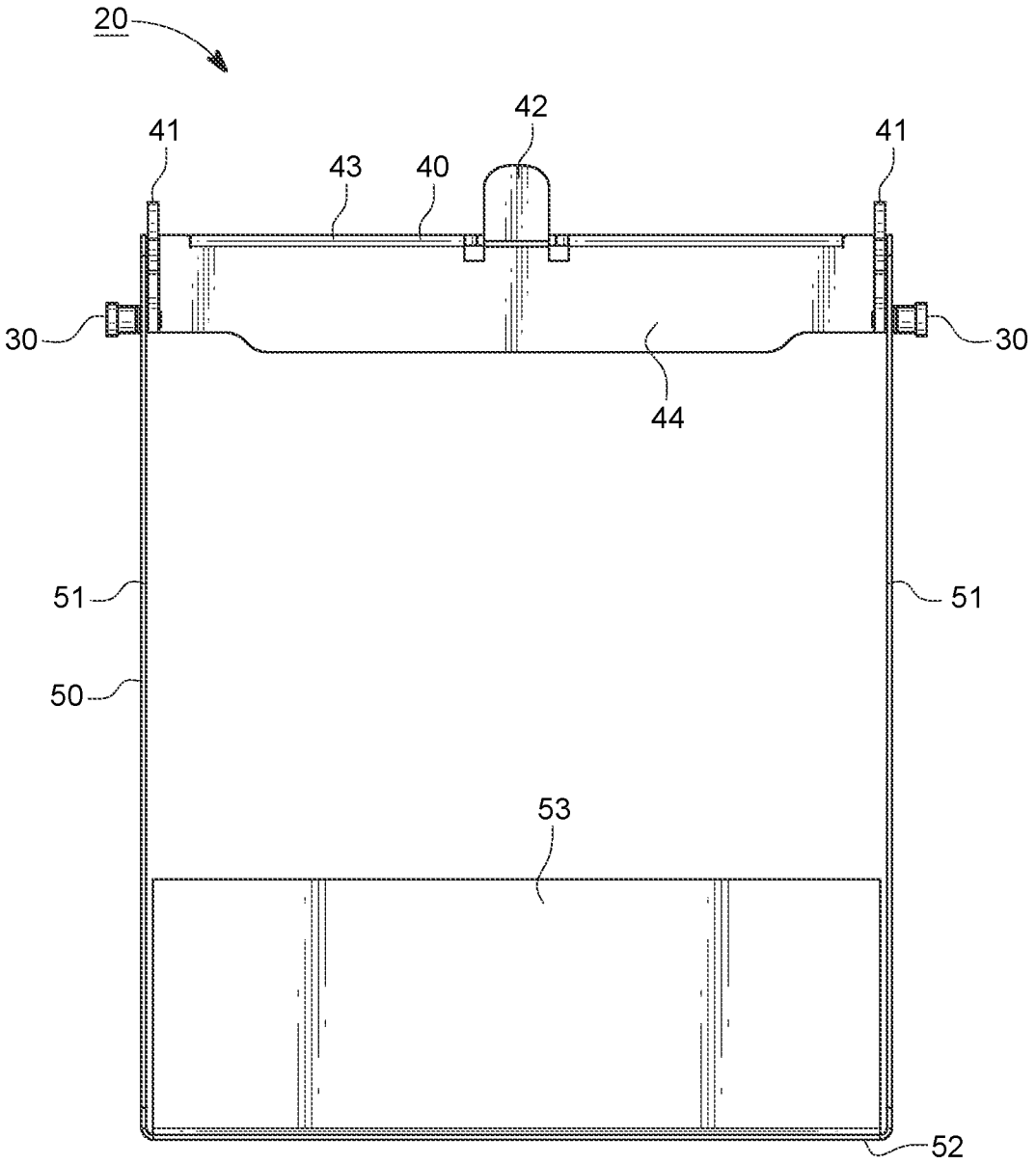
FIG. 4 is a front view of the exemplary bag rack in the first position.
Figure 5:
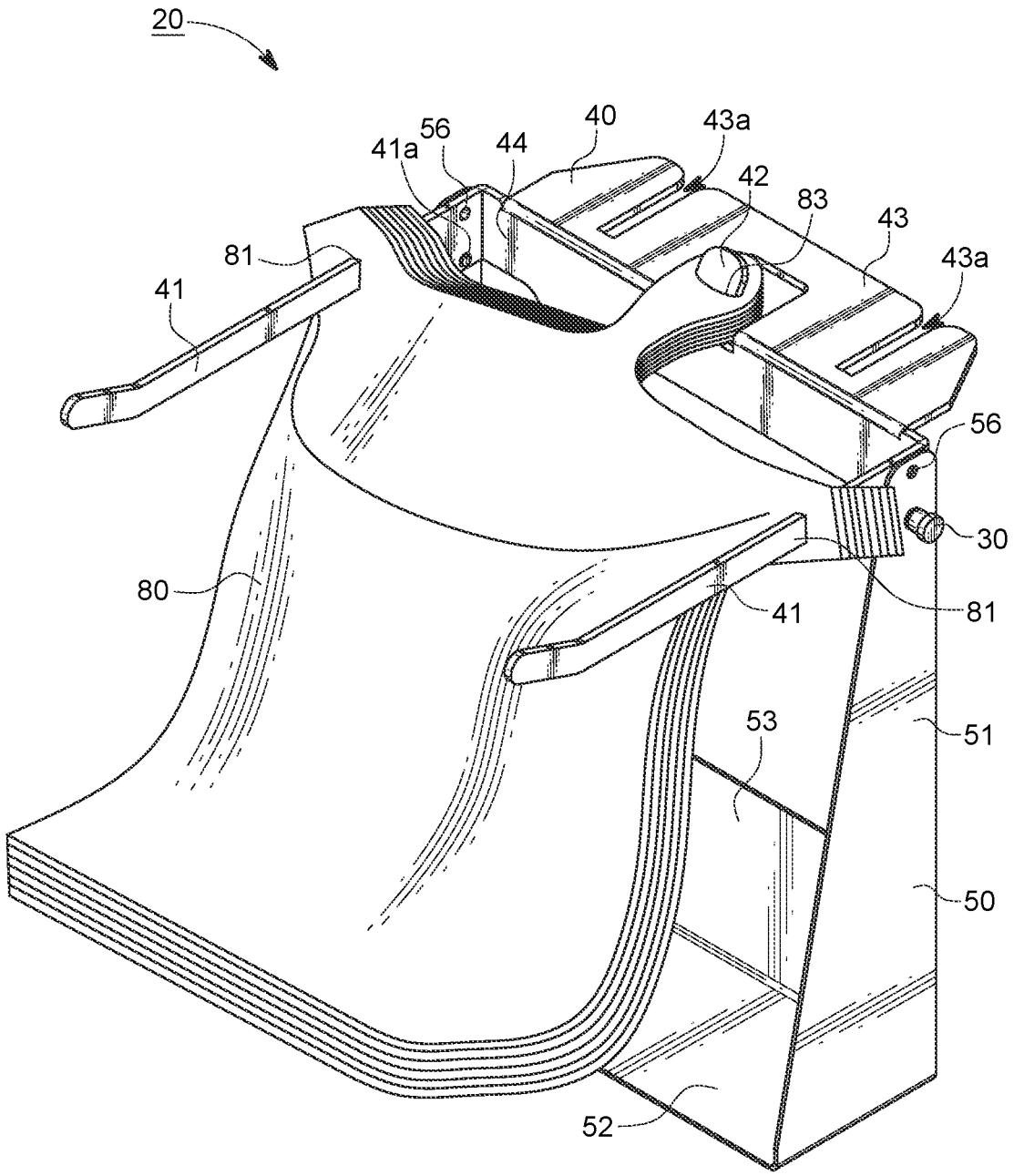
FIG. 5 is a perspective view of an exemplary bag rack in the first position supporting a plastic t-shirt bag.
Figure 6:
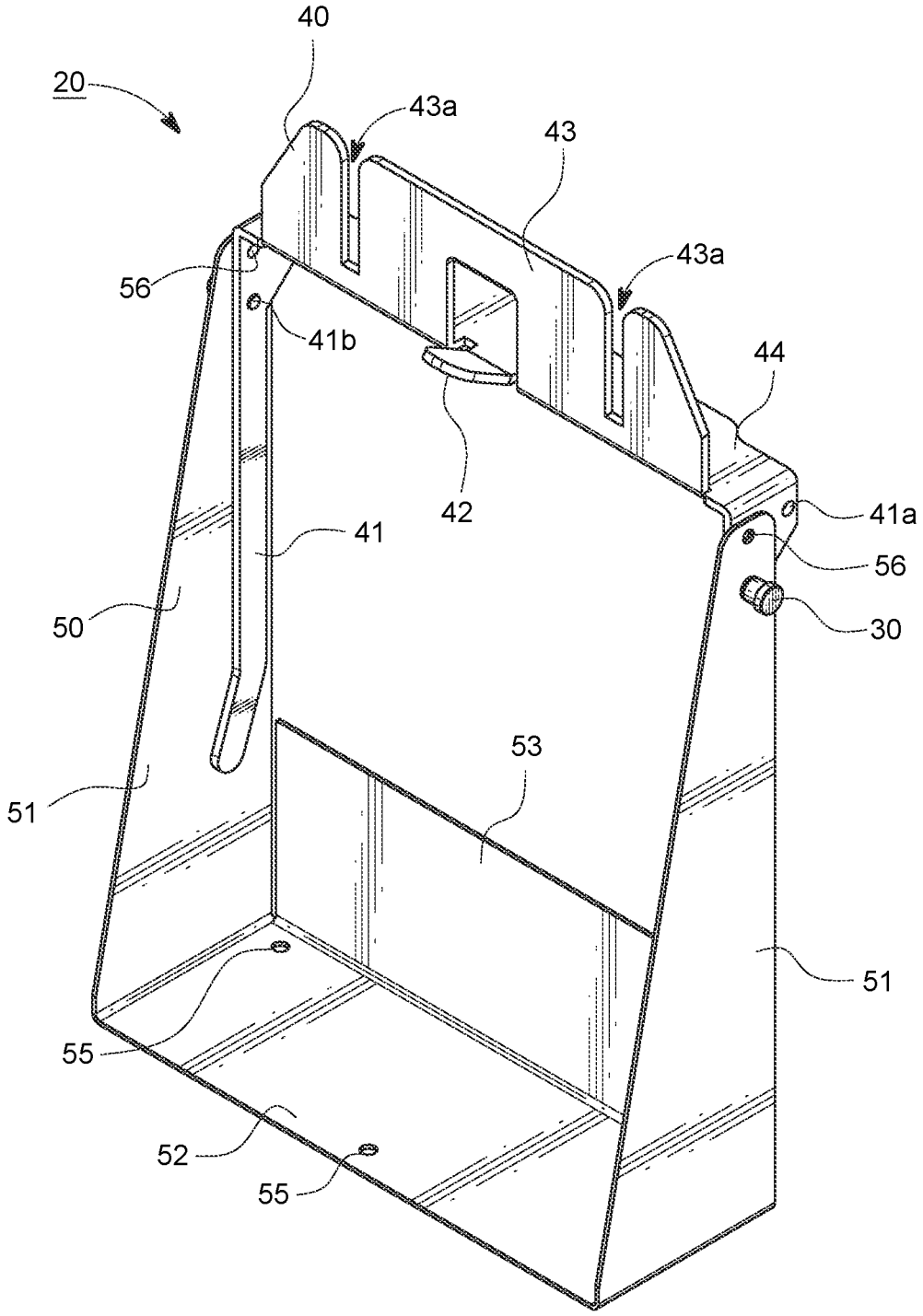
FIG. 6 is a perspective view of an exemplary bag rack in a second position.
Figure 7:
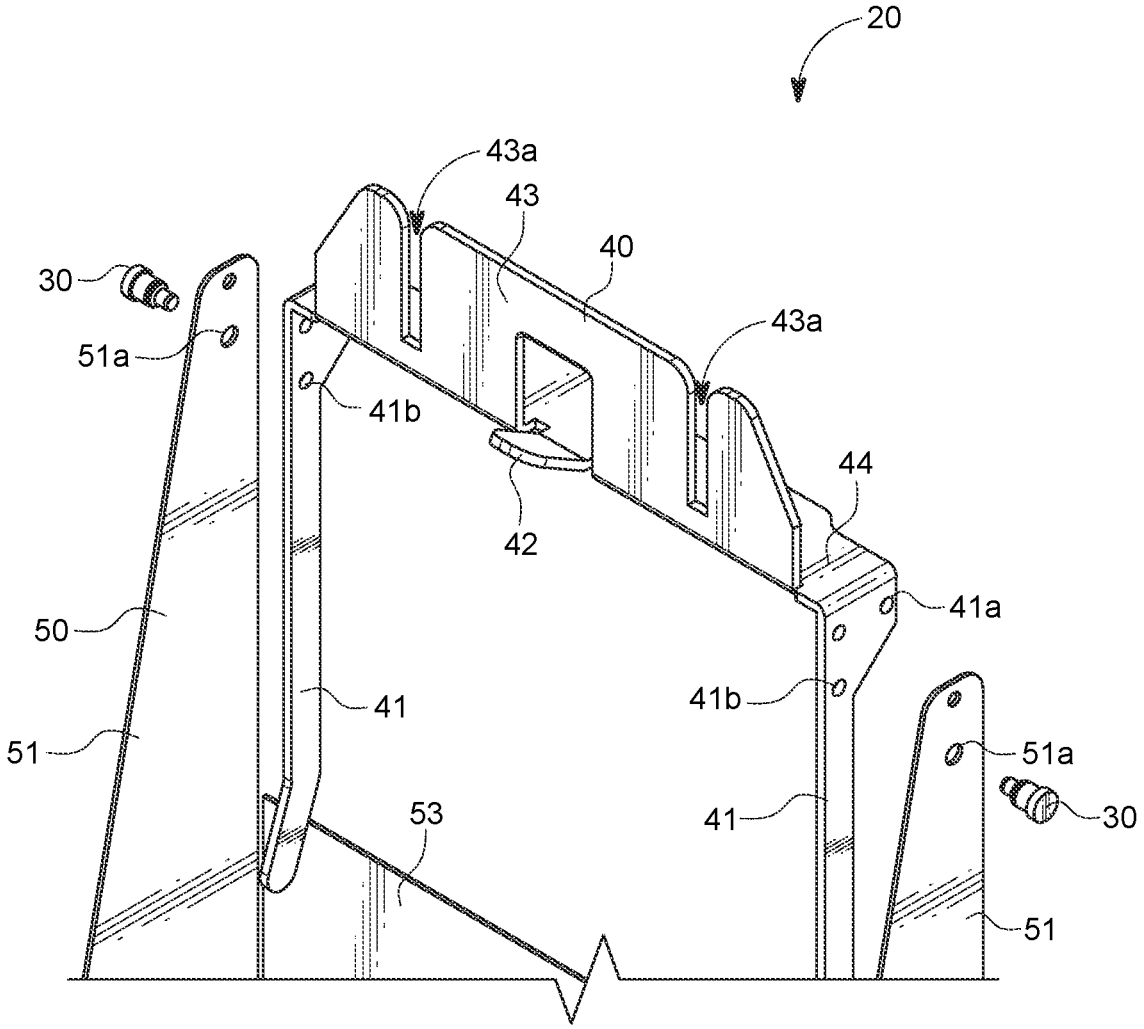
FIG. 7 is an exploded perspective view of the exemplary bag rack in the second position.
Figure 8:
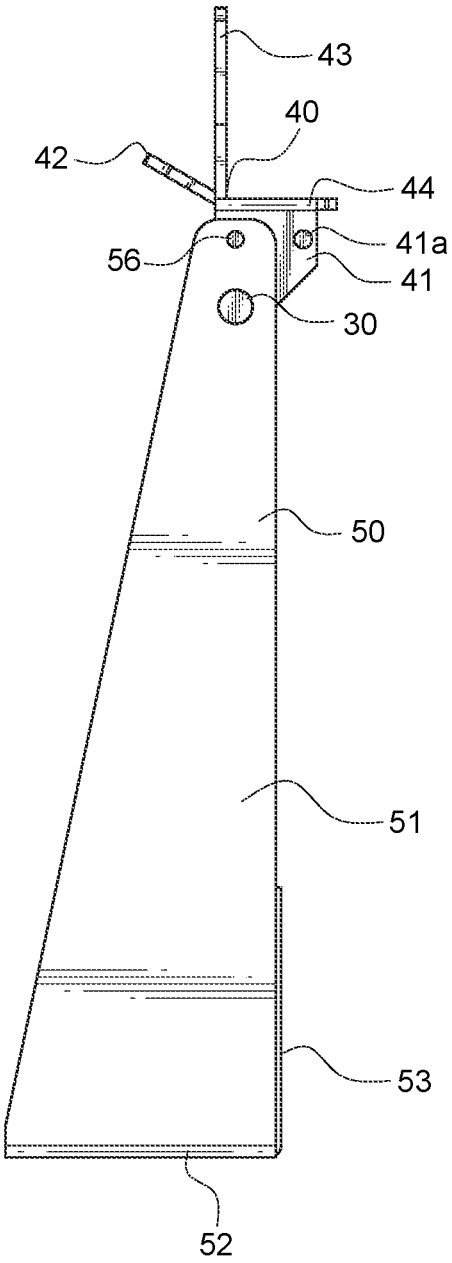
FIG. 8 is a side view of the exemplary bag rack in the second position.
Figure 9:
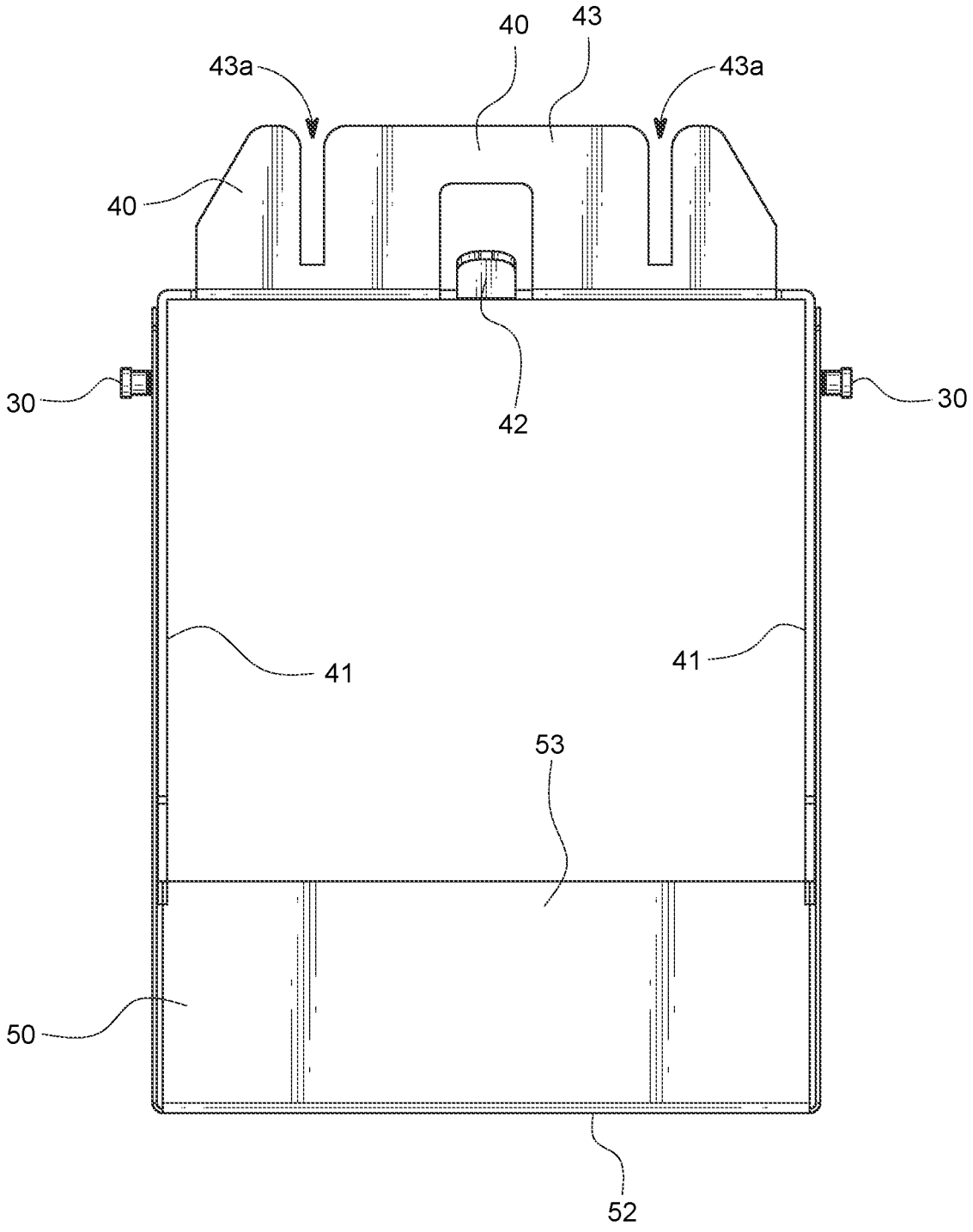
FIG. 9 is a front view of the exemplary bag rack in the second position.
Figure 10:
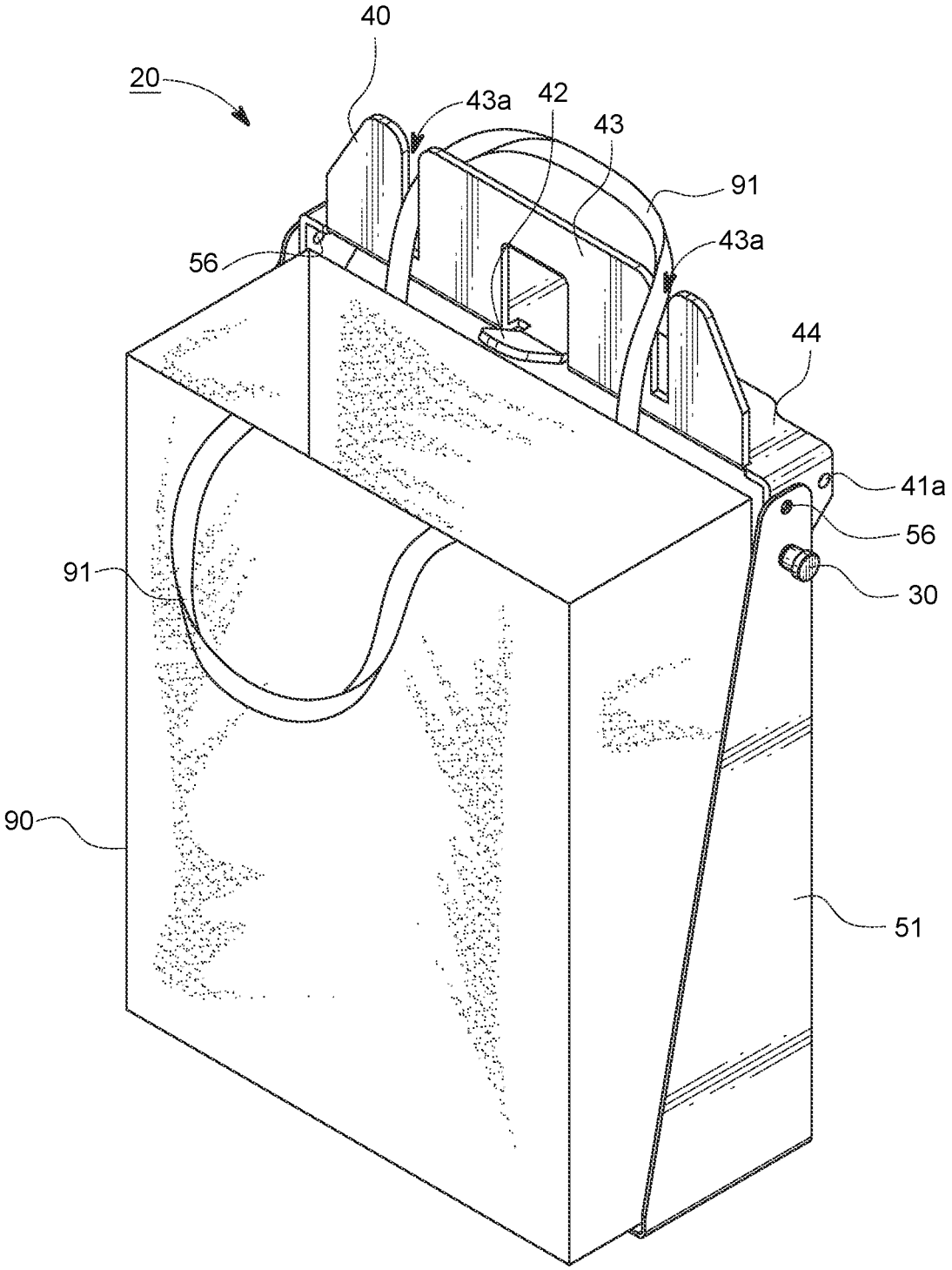
FIG. 10 is a perspective view of an exemplary bag rack in a second supporting a bag.

Referring now to the drawings, an exemplary bag rack 20 according to one embodiment is shown. The bag rack 20 includes three main components: a stand 50, a rack 40 rotatably mounted to the stand 50, and a locking pin 30. The rack 40 is rotatably mounted to the stand 50 by a pivot member 56 so as to be movable from a first support position (shown in FIGS. 1-5 and a second support position (shown in FIGS. 6-10). In the embodiment shown, the bag rack 20 is configured to support plastic, t-shirt bag type in the first support position as shown in FIG. 5, and to support reusable bags in the second support position, as shown in FIG. 10. The locking pin 30 releasably locks the rack 40 in the first and second positions.

The stand 50 comprises a base 52, support arms 51, and back 53, which can be fabricated from a single metal sheet or other suitable material. The base 52 includes one or more openings 55 for mounting the stand 50 to a support surface. Each of the support arms includes pivot member 56 and opening 51*a*, shown in FIGS. 2 and 7. Opening 51*a* is a pass-through for a locking pin 30 that is used to lock the rack 40 in the first and second positions. The operation of the locking pin 30 is described below.

The rack 40 comprises a pair of spaced-apart arms 41 joined by a connecting member 44, a hanger 43, and a support tab 42. The entire rack 40 can be fabricated from a single metal sheet or other suitable material. The rack 40 is rotatably mounted to the stand 50 by pivot member 56 so as to rotate between the first and second support positions. A locking pin 30 is inserted into the aligned pivot member 56 to rotatably mount the rack 40 to the base 50. Each arm 41 includes two additional openings 41*a*, 41*b* that are engaged by the locking member to secure the rack 40 in the first and second positions as hereinafter described.

The arms 41 and tab 42 are configured to engage corresponding openings in a plastic, t-shirt bag type 80 as shown in FIG. 5. Arms 41 engage openings in the loop handles 81 of the t-shirt bag type while the tab 42 engages a center opening 83 in the main body of the t-shirt bag type. When the rack 40 is in the first position, the arms 41 extend forward from the stand 50 and allow the t-shirt type 80 bag to be opened for bagging groceries or the like. In the first position, locking pin 30 is inserted into opening 41*a*, as shown in FIGS. 1-5. When the rack 40 is in the second position, the arms 41 extend downward and are out-of-the-way to allow the use of bag rack 20 with reusable bags. In the second position, locking pin 30 is inserted into opening 41*b*, as shown in FIGS. 6-10.

According to the embodiments shown, tab 42 is connected to the connecting member 44 at a midpoint between arms 41. Tab 42 extends away from connecting member 44, arms 41, and hanger 43.

The hanger 43 comprises a plate extending from the connecting member 44 with two slots 43*a* configured to engage one of the straps 91 on a reusable bag when the rack 40 is in the second position as shown in FIG. 10. The position of the hanger 43 is fixed relative to the arms 41. When the rack 40 is in the second position, a reusable bag 90 can be placed on the base 52 of the stand 50 and the strap towards 91 the back can be looped through the slots 43*a* in the hanger 43. In the first position, the hanger 43 extends backward from the stand 50 so that the stand can be used with plastic, t-shirt style bags.

The locking pin 30 comprises a spring-biased pin mount to the outside of the arms 51. The locking pin 30 includes a pin (not seen in the Figures) that extends through the openings 51*a* in the arms 51 and engages one of the openings 41*a*, 41*b* in the rack 40 depending on the position of the rack 40. In the first position, the pin engages opening 41*a*, while in the second position, the pin engages opening 41*b*. To move the rack 40 between the first and second positions, the user pulls the locking pin outward to disengage the locking pin 30 from the opening 41*a*, 41*b* in the arm 41 so that the rack 40 can rotate. When the rack 40 is in the desired position, the locking pin 30 will engage the opening 41*a*, 41*b* when the locking pin 30 is released.

According to aspects of the present disclosure, the bag rack includes a stand and a rack. The rack is pivotally mounted to the stand so as to be rotatable about a pivot axis relative to the stand between a first position to hold a first bag type and a second position to hold a second bag type. The rack includes a pair of spaced apart arms to hold the first type of bag that, in the first position, extends forward relative to the pivot axis. In the second position, the rack extends downward relative to the pivot axis. The rack also includes a hanger fixed relative to the arms to hold a second bag type that, in the first position, extends backward relative to the pivot axis. In the second position, the rack extends upward relative to the pivot axis.

In another aspect, the rack also includes a tab disposed between the arms configured to engage the first bag type.

In another aspect, the rack also includes a connecting member extending between the arms.

In another aspect, the hanger extends from the top edge of the connecting member.

In another aspect, the connecting member, arms, hanger, and tab include a unitary member.

In another aspect, the back rack also includes a locking mechanism configured to releasably lock the rack relative to the stand in the first position and the second position.

In another aspect, the first bag type bag is a disposable t-shirt bag having two loop handles and a center opening and where the arms are configured to engage the loop handles. Tab is configured to engage the center opening.

In another aspect, the second bag type is a reusable bag having a strap, where the hanger includes slots to engage the strap.

According to one aspect of the present disclosure, the bag rack includes a stand and a rack. The rack pivotally is mounted to the stand so as to be rotatable about a pivot axis relative to the stand between a first position to hold a first bag type and a second position to hold a second bag type. The rack is a unitary member including a pair of spaced apart arms to hold the first bag type that, in the first position, extends forward relative to the pivot axis and, in the second position, extends downward relative to the pivot axis. The rack further includes a connecting member extending between the arms. The rack further includes a tab extending from the connecting member to engage the first bag type. The rack further includes a hanger extending from the connecting member to hold a second bag type that, in the first position, extends backward relative to the pivot axis and, in the second position, extends upward relative to the pivot axis.

In another aspect, the hanger extends from a top edge of the connecting member.

In another aspect, the bag rack further includes a locking mechanism configured to releasably lock the rack relative to the stand in the first position and the second position.

In another aspect, the locking mechanism comprises a locking pin, releasably coupled to the stand, configured to engage the rack in the first position and the second position.

In another aspect, the first bag type is a disposable t-shirt bag having two loop handles and a center opening and wherein the arms are configured to engage the loop handles and the tab is configured to engage the center opening.

In another aspect, the second bag type is a reusable bag having a strap, wherein the hanger comprises slots to engage the strap.

In another aspect, in the first position, the pair of arms is configured to engage the first bag type.

In another aspect, in the second position, the pair of arms is configured to engage the first, when not in use and the hanger is configured to engage the second bag type.

What is claimed:

1. A bag rack comprising:

a stand;

a rack pivotally mounted to the stand so as to be rotatable about a pivot axis relative to the stand between a first position to hold a first bag type and a second position to hold a second bag type, the rack comprising:

a pair of spaced apart arms to hold the first bag type that, in the first position, extends forward relative to the pivot axis and, in the second position, extends downward relative to the pivot axis; and a hanger fixed relative to the arms to hold the second bag type that, in the first position, extends backward relative to the pivot axis and, in the second position, extends upward relative to the pivot axis.

2. The bag rack of claim 1, the rack further comprising:

a tab disposed between the arms configured to engage the first bag type.

3. The bag rack of claim 2, the rack further comprising:

a connecting member extending between the arms.

4. The bag rack of claim 3, wherein the hanger extends from a top edge of the connecting member.

5. The bag rack of claim 3, wherein the connecting member, arms, hanger and tab comprise a unitary member.

6. The bag rack of claim 1, further comprising a locking mechanism configured to releasably lock the rack relative to the stand in the first position and the second position.

7. The bag rack of claim 1, wherein the first bag type is a disposable t-shirt bag having two loop handles and a center opening and wherein:

the arms are configured to engage the loop handles; and the tab is configured to engage the center opening.

8. The bag rack of claim 1, wherein the second bag type is a reusable bag having a strap, wherein the hanger comprises slots to engage the strap.

9. A bag rack comprising:

a stand;

a rack pivotally mounted to the stand so as to be rotatable about a pivot axis relative to the stand between a first position to hold a first bag type and, a second position to hold a second bag type the rack is a unitary member comprising:

a pair of spaced apart arms to hold the first bag type that, in the first position, extends forward relative to the pivot axis and, in the second position, extends downward relative to the pivot axis;

a connecting member extending between the arms;

a tab extending from the connecting member to engage the first bag type; and a hanger extending from the connecting member to hold a second bag type that, in the first position, extends backward relative to the pivot axis and, in the second position, extends upward relative to the pivot axis.

10. The bag rack of claim 9, wherein the hanger extends from a top edge of the connecting member.

11. The bag rack of claim 9, further comprising a locking mechanism configured to releasably lock the rack relative to the stand in the first position and the second position.

12. The bag rack of claim 10, wherein the locking mechanism comprises a locking pin, releasably coupled to the stand, configured to engage the rack in the first position and the second position.

13. The bag rack of claim 9, wherein the first bag type is a disposable t-shirt bag having two loop handles and a center opening and wherein:

the arms are configured to engage the loop handles; and the tab is configured to engage the center opening.

14. The bag rack of claim 9, wherein the second bag type is a reusable bag having a strap, wherein the hanger comprises slots to engage the strap.

15. The bag rack of claim 9, wherein in the first position the pair of arms is configured to engage the first bag type.

16. The bag rack of claim 9, wherein in the second position the hanger is configured to engage the second bag type.

* * * * *